US007134245B2

(12) United States Patent
Burton

(10) Patent No.: US 7,134,245 B2
(45) Date of Patent: Nov. 14, 2006

(54) METHOD AND SYSTEM FOR MANAGING WATER INFILTRATION AT WINDOW OPENINGS

(76) Inventor: Christopher A. Burton, 19100 Mary Ardrey Cir., Cornelius, NC (US) 28031

( * ) Notice: Subject to any disclaimer, the term of this patent is extended or adjusted under 35 U.S.C. 154(b) by 392 days.

(21) Appl. No.: 10/706,171

(22) Filed: Nov. 12, 2003

(65) Prior Publication Data

US 2005/0097837 A1 May 12, 2005

(51) Int. Cl.
*E06B 7/14* (2006.01)

(52) U.S. Cl. ..... 52/209; 52/97

(58) Field of Classification Search ..... 52/97, 52/204.1, 745.15, 745.16, 198, 209, 302.6, 52/302.1, 741.3; 49/408, 471, 476.1
See application file for complete search history.

(56) References Cited

U.S. PATENT DOCUMENTS

| | | | | |
|---|---|---|---|---|
| 1,945,816 | A * | 2/1934 | Leigh | 52/209 |
| 2,570,336 | A * | 10/1951 | Fouts | 52/209 |
| 3,498,974 | A * | 3/1970 | Magnien et al. | 540/605 |
| 4,697,487 | A * | 10/1987 | Cameron | 83/708 |
| 6,098,343 | A | 8/2000 | Brown et al. | |
| 6,119,416 | A | 9/2000 | Larson | |
| 6,385,925 | B1 * | 5/2002 | Wark | 52/209 |

* cited by examiner

*Primary Examiner*—Naoko Slack
*Assistant Examiner*—Jessica Laux
(74) *Attorney, Agent, or Firm*—Schwartz Law Firm P.C.

(57) ABSTRACT

A method is provided for managing water infiltrating a building at a window opening. The method includes, from an inside of the building, accessing a gap formed at a base of the window opening between a window sill and a horizontal window framing member. A flash pan is then installed within the gap to collect water entering the gap.

19 Claims, 5 Drawing Sheets

METHOD AND SYSTEM FOR MANAGING WATER INFILTRATION AT WINDOW OPENINGS

TECHNICAL FIELD AND BACKGROUND OF THE INVENTION

This invention relates to a method and system for managing water infiltration into buildings, and more specifically, infiltration between exterior cladding and windows. The present system is especially applicable for retrofit installation in residential homes and other light-frame structures. Generally, these buildings have increased potential for moisture problems due to energy-efficient construction techniques which emphasize a low level of air leakage. The problems are especially prevalent in colder climates. For these structures, the most effective way to control excessive moisture is to maintain a reasonable level of indoor humidity. In warmer southern climates, problems more often result from moisture coming in from the outside rather than the indoor humidity being too high. This moisture often becomes trapped within the wall cavities. Excessive moisture can decay wood if the moisture remains for extended periods at temperatures greater than approximately 50 degrees F.

According to the National Home Builders Association, the most frequent source of water intrusion is windows. Water frequently enters window locations in two ways—either at the joint around the perimeter of the window, or through seams and joints in the window construction itself. As a first line of defense, builders caulk joints in and around the windows, and install flashing intended to divert water flow away from these interstices. Homeowners are then advised to frequently and thoroughly inspect the windows, flashing, and sealant/caulk. Any damaged flashing should be repaired or replaced immediately. Any cracked or deteriorated sealants should be immediately repaired or removed and replaced. It is also recommended that periodic moisture testing be done to check for any potential problem areas.

The reality for most homeowners is a general failure to consistently inspect and properly maintain windows. Moreover, because the location of water entry is often difficult to see, any damage occurring behind the exterior cladding frequently cannot be detected by visual inspection. If undetected or ignored, continued water intrusion will ultimately damage building sheathing and wood structural members. In addition to this physical damage, moisture problems in the home are being linked to personal injury based on the severe allergic reactions some people have to molds that grow in moistened areas inside the walls.

SUMMARY OF INVENTION

Therefore, it is an object of the invention to provide a retrofit drain system for managing water infiltration at window openings. The system is especially applicable for buildings such as residential homes and other light-frame structures.

It is another object of the invention to provide a window drain system which is installed from an interior of the building.

It is another object of the invention to provide a window drain system which is quickly and conveniently installed without the use of ladders or scaffolding.

It is another object of the invention to provide a window drain system which is relatively inexpensive to manufacture.

It is another object of the invention to provide a window drain system which requires relatively little skill and labor to install.

It is another object of the invention to provide a window drain system which requires little if any modification of the horizontal sill support stud (commonly referred to as the "rough sill" or "rough sill").

It is another object of the invention to provide a window drain system which does not penetrate the interior wall cavity.

It is another object of the invention to provide a window drain system which requires no cutting, patching or reskimming of the exterior cladding.

It is another object of the invention to provide a window drain system which is applicable to any exterior cladding system including brick, stucco, vinyl, wood, Masonite, cedar shake, Hardy Plank, and the like.

It is another object of the invention to provide a window drain system which offers enhanced performance as compared to existing retrofit installations.

It is another object of the invention to provide a window drain system which avoids existing electrical wiring, such as that used for alarm systems.

It is another object of the invention to provide a window drain system which requires little if any cosmetic or structural repair in or around the window after installation.

It is another object of the invention to provide a window drain system which is easily monitored to verify proper and effective operation.

It is another object of the invention to provide a method of managing water infiltration in buildings.

It is another object of the invention to provide a method for installing a window drain system within a gap formed between a sloped window sill and a horizontal sill support stud.

These and other objects of the present invention are achieved in the preferred embodiments disclosed below by providing a method for managing water infiltrating a building at a window opening. The method includes, from an inside of the building, accessing a gap formed at a base of the window opening between a window sill and a horizontal window framing member. A flash pan is then installed within the gap to collect water entering the gap.

According to another preferred embodiment of the invention, the step of installing includes locating the flash pan at a bottom corner of the window opening adjacent a vertical window framing member extending perpendicularly upward from the horizontal window framing member.

According to another preferred embodiment of the invention, the step of installing further includes locating a second flash pan at an opposite bottom corner of the window opening adjacent a second vertical window framing member extending perpendicularly upward from the horizontal window framing member.

According to another preferred embodiment of the invention, the method includes interconnecting the first and second flash pans through a connecting tube.

According to another preferred embodiment of the invention, the step of accessing the gap includes first removing interior trim located adjacent the window opening.

According to another preferred embodiment of the invention, the method includes promoting the flow of water collecting in the flash pan towards an outlet formed in the flash pan.

According to another preferred embodiment of the invention, the method includes transporting the water from the outlet in the flash pan through a drain tube extending away from the gap.

According to another preferred embodiment of the invention, the method includes extending a free end of the drain tube through an exterior wall of the building to drain water outside of the building.

In another embodiment, the invention is a system for managing water infiltrating a building at a window opening. The system includes a flash pan for being located within a gap formed at a base of the window opening between a window sill and a horizontal window framing member. The flash pan operates to collect water entering the gap. The flash pan defines a sloped bottom wall for promoting the flow of water towards an outlet formed in the flash pan. The term "sloped" refers to any downwardly curved or angled surface. A drain tube communicates with the outlet of the flash pan, and is adapted for transporting water collecting in the flash pan away from the gap.

According to another preferred embodiment of the invention, the flash pan includes opposing end dams.

According to another preferred embodiment of the invention, the outlet is formed in at least one of the opposing end dams.

According to another preferred embodiment of the invention, a plurality of flash pans are located within the gap to collect water entering the gap.

According to another preferred embodiment of the invention, a connecting tube interconnects the plurality of flash pans and communicates with the drain tube for transporting water collecting in the flash pans away from the gap.

According to another preferred embodiment of the invention, the flash pan has a number of spaced longitudinal reinforcement ribs.

According to another preferred embodiment of the invention, a lateral support bridge extends from one side of the flash pan to the other to provide stability and structural support.

In yet another embodiment, the invention is an improved window frame assembly including spaced-apart vertical framing members and horizontal top and bottom framing members cooperating to define a window opening. The improvement comprises a system adapted for managing water infiltrating a building at the window opening. The system includes a flash pan located within a gap formed at a base of the window opening between a window sill and the bottom horizontal framing member. The flash pan operates to collect water entering the gap. The flash pan defines a sloped bottom wall which promotes the flow of water towards an outlet formed in the flash pan. A drain tube communicates with the outlet of the flash pan, and is adapted for transporting water collecting in the flash pan away from the gap.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
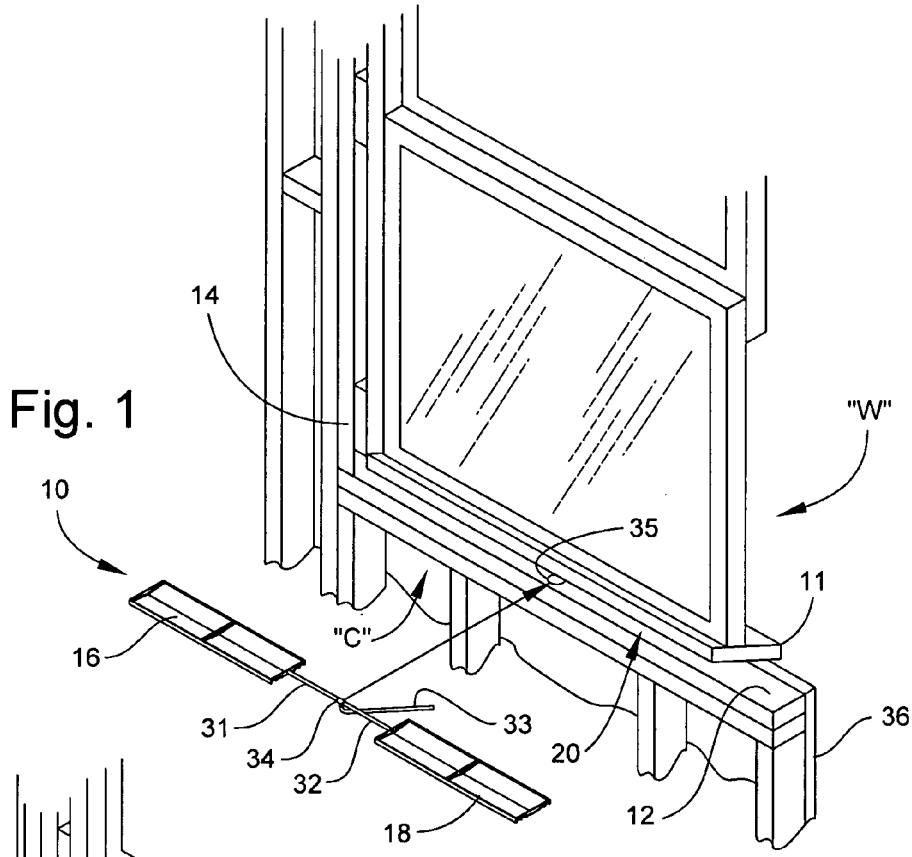
FIG. 1 is a perspective view of a window drain system according to one preferred embodiment of the present invention, and showing the system removed from an existing window.
Figure 2:
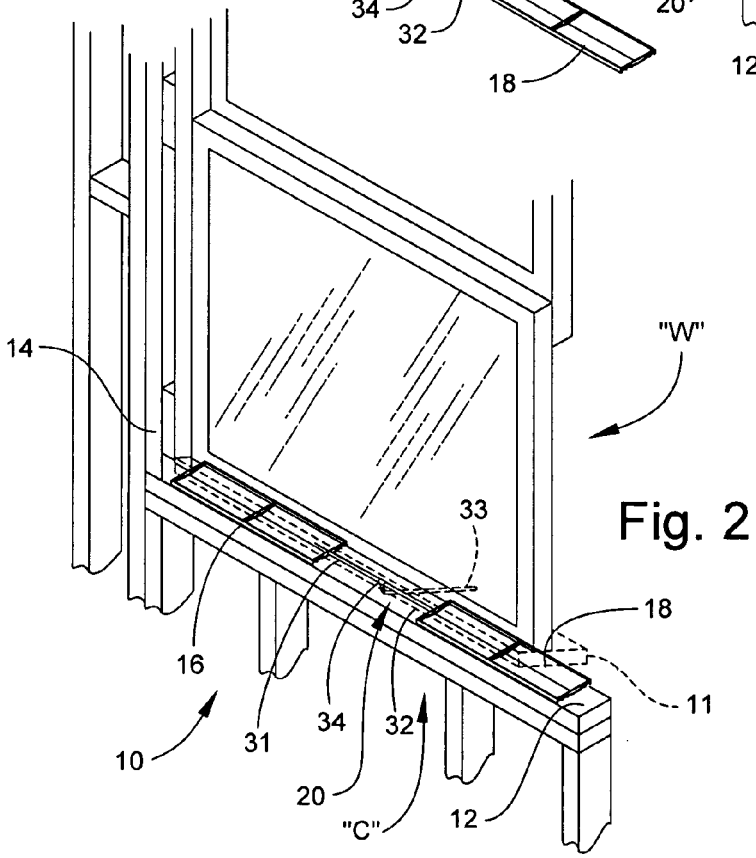
FIG. 2 is a perspective view of the window drain system after installation.

Referring now specifically to the drawings, a window drain system according to the present invention is illustrated in FIG. 1, and shown generally at reference numeral 10. The system 10 is especially applicable for retrofit installation below an existing window "W" of a residential home or other light-frame structure. As best shown in FIGS. 1, 3, 6, and 7, the window "W" has a sloped sill 11 which extends adjacent a horizontal framing member 12 (or "rough sill"), and between spaced-apart vertical framing members 14 and 15 (or "jack studs").

The present system 10 includes a pair of low-profile flash pans 16 and 18 which reside in a small gap 20 formed between the sloped window sill 11 and the horizontal rough sill 12. The spaced vertical distance from the rear of the window sill 11 to the rough sill 12 is generally between 0.5 to 1.5 inches tapering towards the front of the window sill 11. The flash pans 16, 18 sit directly on the rough sill 12, and are designed to capture water which would otherwise infiltrate the interior wall cavity "C" at the joints of the rough sill 12 and jack studs 14, 15. These areas of the rough window opening are generally not sealed, and are responsible for approximately 80% to 90% of all water leakage into the wall cavity "C".

Figure 4:
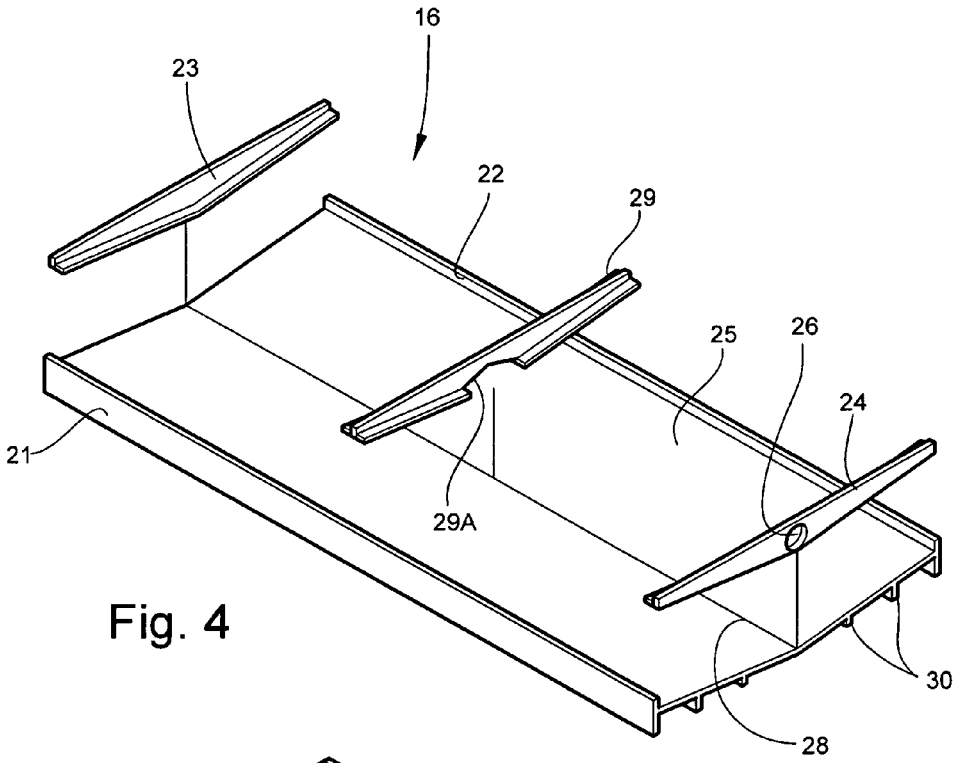
FIG. 4 is an enlarged perspective view of the flash pan with the end walls and reinforcing bridge removed.
Figure 5:
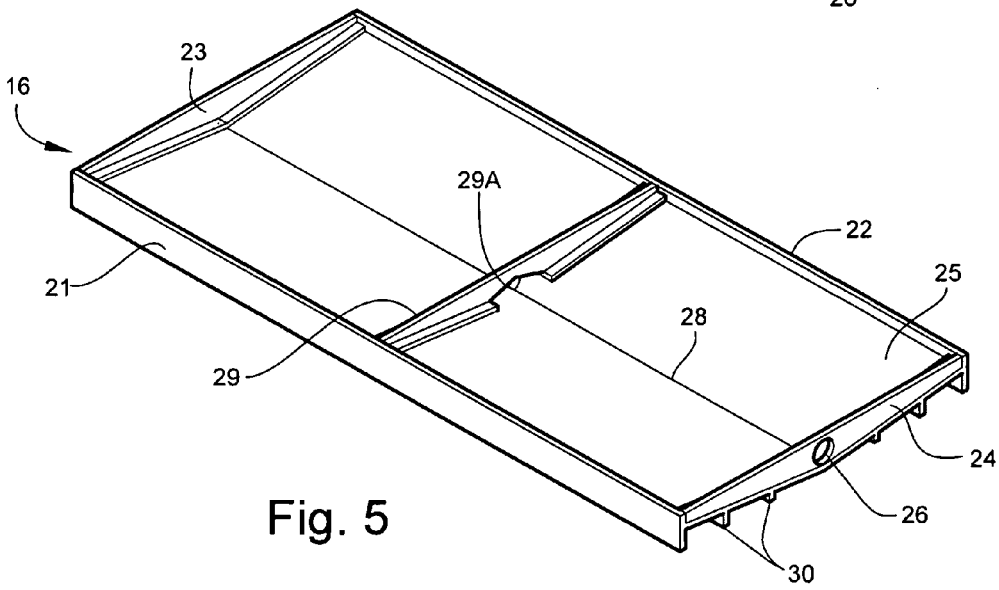
FIG. 5 is an enlarged perspective view of the flash pan with the end wall and reinforcing bridge attached.
Figure 6:
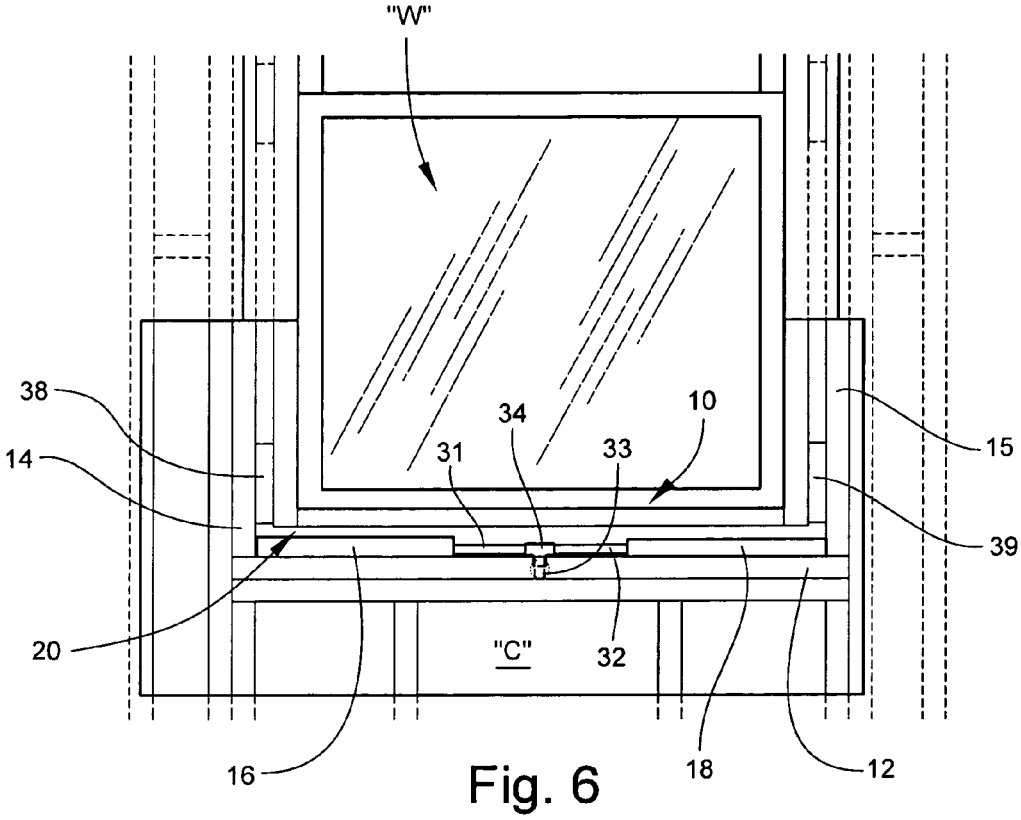
FIG. 6 is a front view of the window with the drain system installed, and the interior window trim removed.

FIGS. 4 and 5 illustrate the structure and components of flash pan 16—flash pan 18 being an identical mirror image. Each flash pan 16, 18 has spaced-apart longitudinal side walls 21 and 22, opposing end walls 23 and 24, and a pitched bottom 25. The side walls 21, 22 and bottom 25 are integrally formed together in a single extrusion which is cut to any desired length prior to installation of the flash pan 16, 18 in order to custom fit a particular window "W". The end walls 23, 24 are then affixed by gluing or other suitable means. For optimum operation of the system 10, the outside end wall 23 of the flash pan 16, 18 closely and directly abuts the vertical jack stud 14, 15, as shown in FIG. 6. The inside end wall 24 has a drain opening 26 located adjacent a center low point 28 of the pitched bottom 25. For added lateral support, a centrally located reinforcing bridge 29 is attached to the pitched bottom 25. Water collecting in the flash pan 16, 18 flows to the low point 28 of the bottom 25, through a cut-out 29A formed in the bridge 29, and then outwardly through the drain opening 26. Preferably, longitudinal ribs 30 are formed with the underside of the pitched bottom 25 to support and stabilize the pan 16, 18 on the rough sill 12. According to one embodiment, each flash pan is approximately 3.5 inches wide, as measured from one side wall to the other, and 0.5 inches deep, as measured from the top of the side walls to the low point of the pitched bottom.

Figure 3:
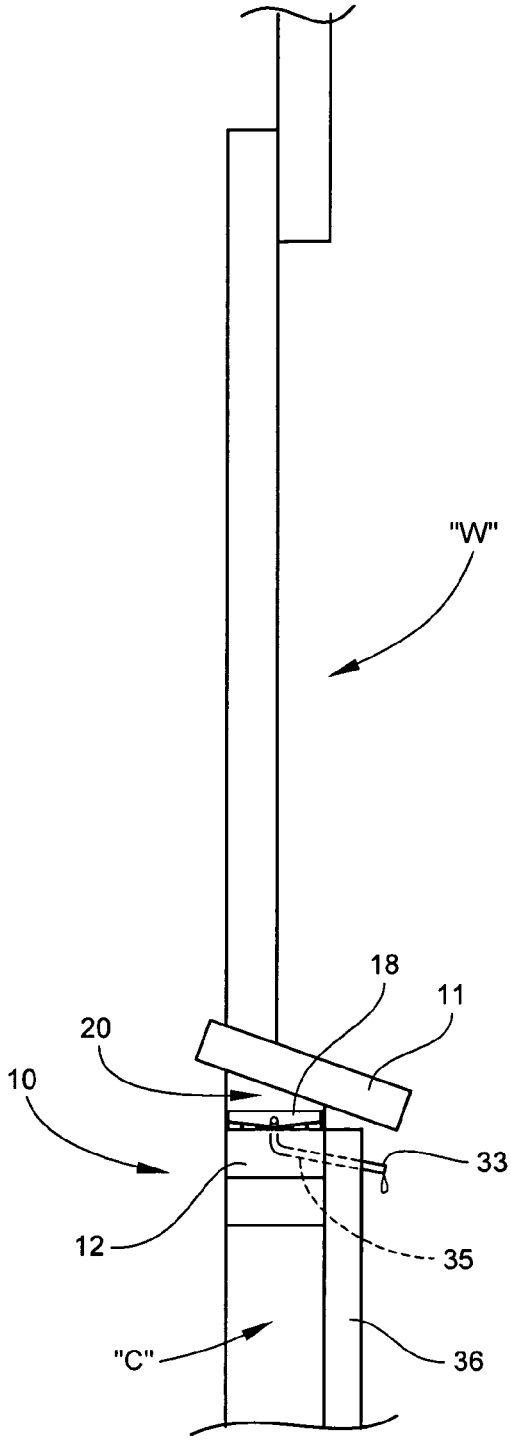
FIG. 3 is a side view of the window drain system as installed.

As best shown in FIGS. 1, 5, 6, and 7, respective drain tubes 31 and 32 are connected to the flash pans 16, 18 at the drain openings 26, and communicate with a third drain tube 33 at a T-shaped, slip-on compression fitting 34. The drain tube 33 extends from the fitting 34 through a passage 35 formed with the rough sill 12 and exterior cladding 36, as shown in FIG. 3. The tubes 31, 32, and 33 cooperate to transport water from the flash pans 16, 18 and away from the window gap 20 and wall cavity "C" where it safely drains outside of the building. According to one embodiment, the drain tubes 31, 32, and 33 are constructed of ⅜-inch flexible plastic tubing.

Installation of Window Drain System

Figure 7:
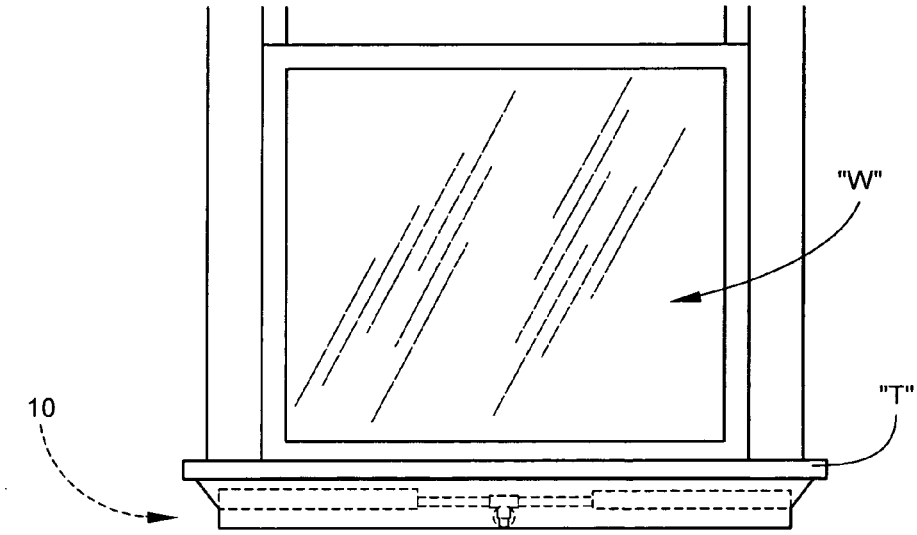
FIG. 7 is a front view of the window with the drain system installed and the interior wood trim replaced.

Unlike conventional prior art systems, the present window drain system 10 is readily and conveniently installed from inside the building. Referring to FIGS. 6 and 7, the installer first removes existing interior wood trim "T" located at the base of the window "W" to expose the gap 20 between the sloped window sill 11 and the rough sill 12. If necessary, any portion of the vertical window jambs 38, 39 extending into the gap 20 may be removed in order to position the flash pans 16, 18 directly against the vertical jack studs 14, 15. Any plastic barrier applied to the jack studs 14, 15 is cut to overlap the outside end walls 23 and direct moisture flow into the flash pans 16, 18. After positioning the flash pans 16, 18 within the gap 20, the drain tube 33 is fed through the passage 35 formed in the rough sill 12 and exterior cladding 36 in order to drain collected water outside the building, as previously described. The passage 35 is preferably formed entirely outside of the interior wall cavity "C" to guard against any inadvertent water leakage into the cavity, and to facilitate extension of the drain tube 33 through the exterior cladding 36. Once installation is complete, the installer simply replaces the interior wood trim "T" with no further necessary repair or cosmetic wall patching. Operation of the system 10 can then be conveniently monitored by visually inspecting the exposed end of the drain tube 33 for water leakage.

ALTERNATIVE EMBODIMENTS

Figure 8:
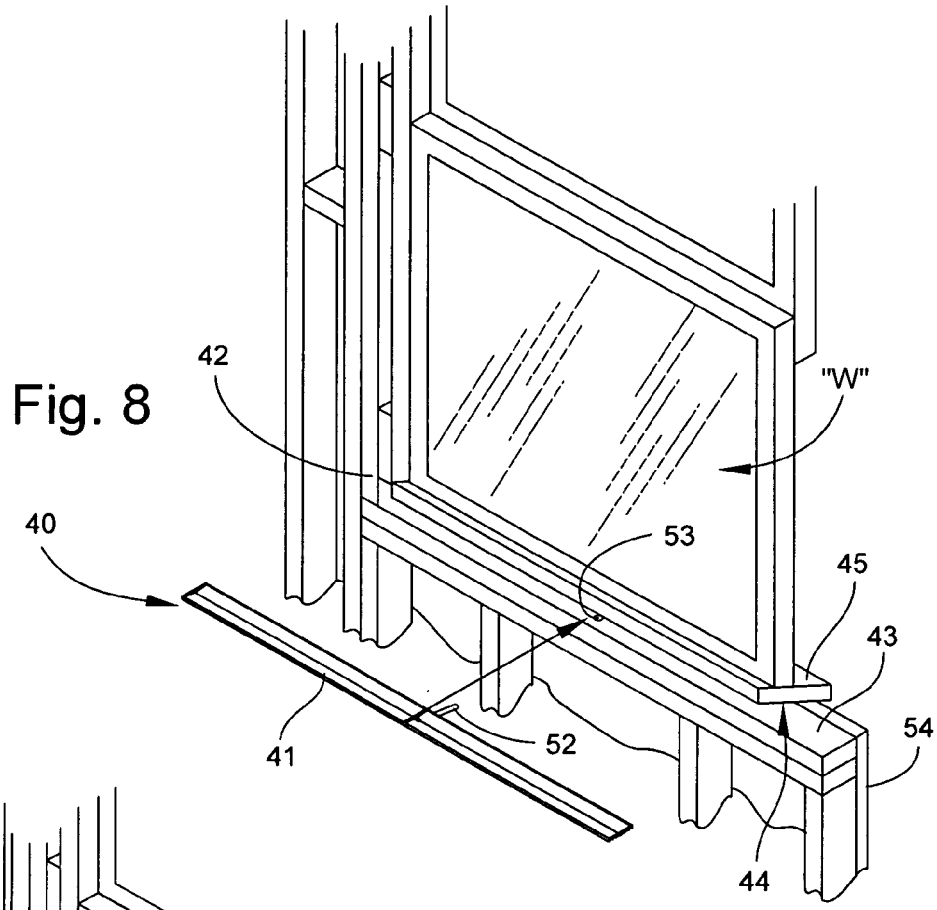
FIG. 8 is a perspective view of a window drain system according to a second preferred embodiment of the present invention, and showing the system removed from an existing window.
Figure 9:
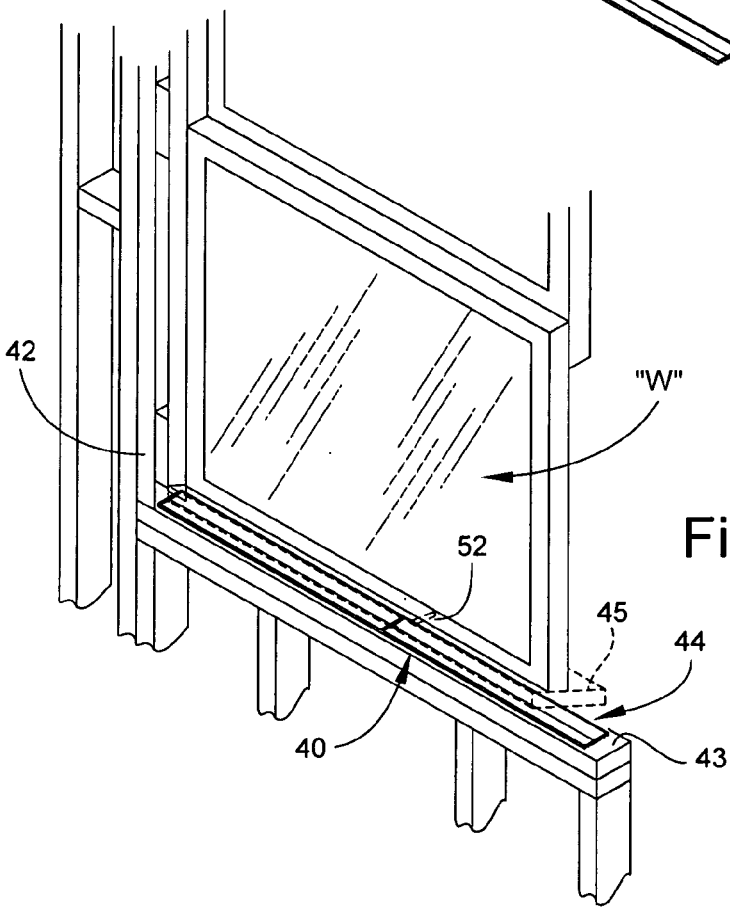
FIG. 9 is a perspective view of the window drain system of FIG. 8 after installation.

A second embodiment of a window drain system 40 according to the present invention is illustrated in FIGS. 8 and 9. The system 40 includes a single flash pan 41 extending from one vertical jack stud 42 to the other (not shown). The flash pan 41 sits on the rough sill 43 within the gap 44 formed between the rough sill 43 and the window sill 45. The flash pan 41 has spaced-apart longitudinal side walls 46 and 47, opposing end walls 48 and 49, and a pitched bottom 50. The side walls 46, 47 and bottom 50 are integrally formed together in a single extrusion which is cut prior to installation of the flash pan 41 in order to custom fit the window "W". The end walls 48, 49 are then affixed by gluing or other suitable means. For optimum operation, the end walls 48, 49 closely and directly abut the vertical jack studs 42. A central drain opening 51 is formed in the pitched bottom 50 and connects to a single drain tube 52 which extends from the flash pan 41 through a passage 53 formed with the rough sill 43 and exterior cladding 54 to the outside of the building. This system 40 is likewise installed from inside the building in a manner identical to that described above.

A system and method for managing water infiltration at windows is described above. Various details of the invention may be changed without departing from its scope. Furthermore, the foregoing description of the preferred embodiment of the invention and best mode for practicing the invention are provided for the purpose of illustration only and not for the purpose of limitation— the invention being defined by the claims.

I claim:

1. A method for managing water infiltrating a building at a window opening, said method comprising the steps of:

(a) from an inside of the building, accessing a gap formed at a base of the window opening between a window sill and a horizontal window framing member; and (b) installing a flash pan within the gap to collect water entering the gap, and comprising locating the flash pan at a bottom corner of the window opening adjacent a vertical window framing member extending perpendicularly upward from the horizontal window framing member, and locating a second flash pan at an opposite bottom corner of the window opening adjacent a second vertical window framing member extending perpendicularly upward from the horizontal window framing member.

2. A method according to claim 1, and comprising interconnecting the flash pan and the second flash pan through a connecting tube.

3. A method according to claim 1, wherein the step of accessing the gap comprises removing interior trim located adjacent the window opening.

4. A method according to claim 1, and comprising promoting the flow of water collecting in the flash pan towards an outlet formed in the flash pan.

5. A method according to claim 4, and comprising transporting the water from the outlet in the flash pan through a drain tube extending away from the gap.

6. A method according to claim 5, and comprising extending a free end of the drain tube through an exterior wall of the building to drain water outside of the building.

7. A system adapted for managing water infiltrating a building at a window opening, said system comprising:

(a) a flash pan for being located within a gap formed at a base of the window opening between a window sill and a horizontal window framing member, said flash pan operating to collect water entering the gap, and defining a sloped bottom wall for promoting the flow of water towards an outlet formed in said flash pan; and (b) a drain tube communicating with the outlet of said flash pan and adapted for transporting water collecting in said flash pan away from the gap.

8. A system according to claim 7, wherein said flash pan comprises opposing end dams.

9. A system according to claim 8, wherein said outlet is formed in at least one of said opposing end dams.

10. A system according to claim 7, and comprising a plurality of flash pans adapted for being located within the gap to collect water entering the gap.

11. A system according to claim 10, and comprising a connecting tube interconnecting said plurality of flash pans and communicating with said drain tube for transporting water collecting in said flash pans away from the gap.

12. A system according to claim 7, wherein said flash pan comprises longitudinal reinforcement ribs.

13. A system according to claim 7, and comprising a lateral support bridge extending from one side of said flash pan to the other.

14. In a window frame assembly comprising spaced-apart vertical framing members and horizontal top and bottom framing member cooperating to define a window opening, a system adapted for managing water infiltrating a building at said window opening, said system comprising:

(a) a flash pan located within a gap formed at a base of said window opening between a window sill and the bottom horizontal framing member, said flash pan operating to collect water entering said gap, and defining a sloped bottom wall for promoting the flow of water towards an outlet formed in said flash pan; and (b) a drain tube communicating with the outlet of said flash pan and adapted for transporting water collecting in said flash pan away from the gap.

15. A window frame assembly according to claim 14, wherein said flash pan comprises opposing end dams.

16. A window frame assembly according to claim 15, wherein said pan outlet is formed in at least one of said opposing end dams.

17. A window frame assembly according to claim 14, and comprising a plurality of flash pans located within the gap to collect water entering the gap.

18. A window frame assembly according to claim 17, and comprising a connecting tube interconnecting said plurality of flash pans and communicating with said drain tube for transporting water collecting in said flash pans away from the gap.

19. A method for managing water infiltrating a building at a window opening, said method comprising the steps of:

(a) from an inside of the building, accessing a gap formed at a base of the window opening between a window sill and a horizontal window framing member, the step of accessing the gap comprising removing interior trim located adjacent the window opening; and (b) installing a flash pan within the gap to collect water entering the gap.

* * * * *